United States Patent [19]

Fritz

[11] 4,316,082

[45] Feb. 16, 1982

[54] COMPUTER CONTROL APPARATUS

[75] Inventor: John R. Fritz, Phoenix, Ariz.

[73] Assignee: Honeywell Inc., Minneapolis, Minn.

[21] Appl. No.: 119,125

[22] Filed: Feb. 6, 1980

[51] Int. Cl.[3] ..... G06C 7/02

[52] U.S. Cl. ..... 235/146; 312/208; 312/313

[58] Field of Search ..... 235/10, 145 R, 145 A, 235/146, 12, 55 R, 61 PE, 61 PD, 59 R; 234/123-125; 364/200, 900; 312/21, 26, 208, 313, 196, 233, 281, 322, 277.5, 273, 274; 340/147 R, 365 R, 365 S; 200/5 R

[56] References Cited

U.S. PATENT DOCUMENTS 3,778,125 12/1973 Gutmann, Jr. et al. ..... 312/208

4,107,784 8/1978 Van Bemmelen ..... 364/900

*Primary Examiner*—Joseph W. Hartary

*Assistant Examiner*—Benjamin R. Fuller

*Attorney, Agent, or Firm*—Laurence J. Marhoefer; Lockwood D. Burton

[57] ABSTRACT

A computer interface console includes a cathode ray tube display, an operators keyboard, and an engineers keyboard. The engineers keyboard is so mounted that it may be moved to a position in front of the console in substantial alignment with the cathode ray tube and the operators keyboard when it is desired to make changes in the computer data base. At other times, the engineers keyboard is moved to a retracted position below the work space of the console, under the operators keyboard. In that retracted position, the work space is clear and uncluttered by the engineers keyboard. Additionally, with the engineers keyboard in the retracted position, it is unobstrusive and unavailable to unauthorized operators. Thus the probability of inadvertent or unauthorized manipulation of the engineers keyboard is greatly reduced.

4 Claims, 5 Drawing Figures

COMPUTER CONTROL APPARATUS

BACKGROUND OF THE INVENTION

The present invention relates to computer control apparatus. More particularly, it relates to a retractable keyboard for a computer operator station, or interface console. In the use of digital computers for the control and manipulation of data, either for the sake of data itself, or as a real time controller for an on-going industrial process, there is provided an operator interface console. The console includes a display apparatus such as a cathode ray tube for displaying data, in accordance with a predetermined format, or in one of several predetermined formats. The console also includes an operators keyboard by means of which the operator may call for data from the computer and select the predetermined format in which the data is to be displayed. The operator keyboard also enables the operator to insert data into the computer system and to change certain parameters.

In addition to the operators keyboard, means are also provided for establishing or setting the predetermined formats, for establishing or changing the data base for the computer, for setting up certain graphics for display on the display device as a function of the computer data changes of this type may be considered as engineering changes in the computer operation. One means for accomplishing the latter feature is a so-called engineers keyboard. Heretofore, it has been the practice to make the engineers keyboard a fixed part of the console. Alternatively, the engineers keyboard has been in the form of a portable, separate module. In the fixed form, the engineers keyboard has been installed as an extra keyboard in the work space of the console. In the module form the module rested on the work space surface of the console. In either form the engineers keyboard, although used infrequently, is necessary, and clutters and reduces the available work space. Additionally, being on top and in view, it presents the potential for inadvertant manipulation by an operator who is not trained or authorized to affect the changes that would result from such manipulation. Such unauthorized changes would tend to invalidate the computer operation and, in the case of an industrial process system may have disastrous results.

SUMMARY OF THE INVENTION

It is, accordingly, an object of the present invention to provide an improved computer interface console with a retractable engineer's keyboard.

It is another object of the present invention to provide a retractable keyboard for a computer interface console.

In accomplishing these and other objects, there has been provided, in accordance with the present invention, a computer interface console having a cathode ray tube display, an operators keyboard, and an engineers keyboard. The engineers keyboard is so mounted that it may be moved to a position in front of the console in substantial alignment with the cathode ray tube and the operators keyboard when it is desired to make changes in the computer data base. At other times, the engineers keyboard is moved to a retracted position below the work space of the console, under the operators keyboard. In that retracted position, the work space is clear and uncluttered by the engineers keyboard. Additionally, with the engineers keyboard in the retracted position, it is unobstrusive and unavailable to unauthorized operators. Thus the probability of inadvertent or unauthorized manipulation of the engineers keyboard is greatly reduced.

BRIEF DESCRIPTION OF THE DRAWINGS

A better understanding of the present invention may be had from the following detailed description when read in the light of the accompanying drawings, in which.

DETAILED DESCRIPTION

Figure 1:
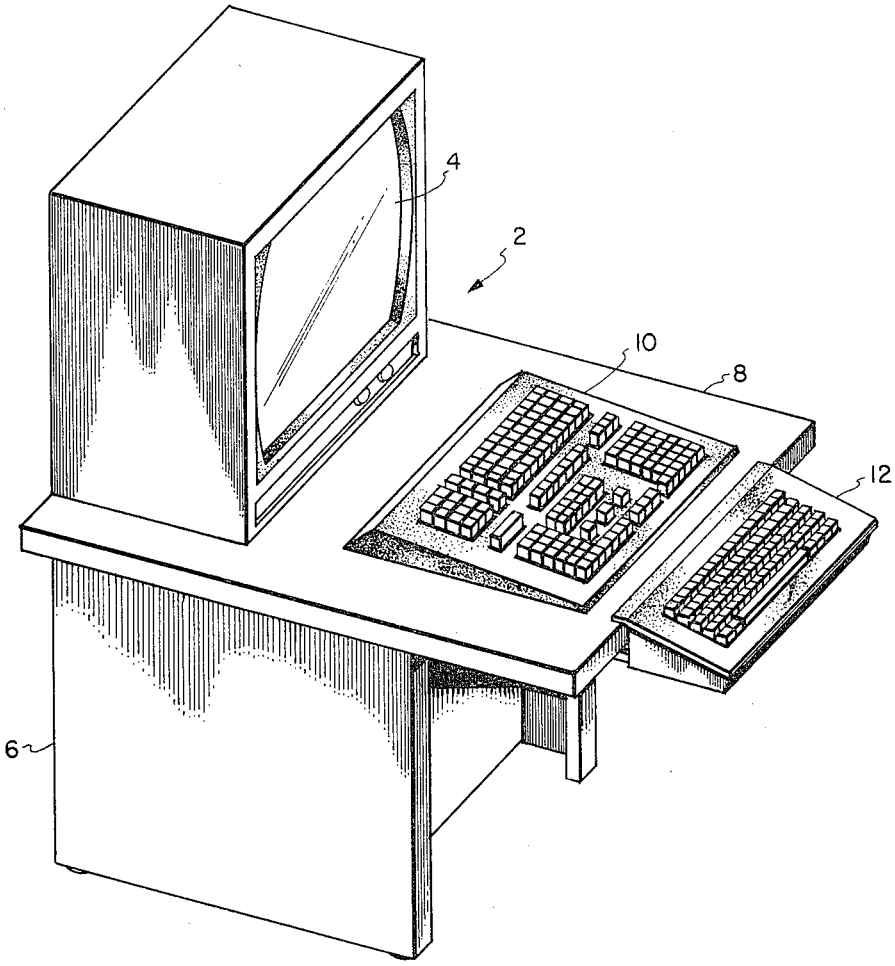
FIG. 1 is a perspective view of a computer interface console with a retractable engineers keyboard extended.
Figure 2:
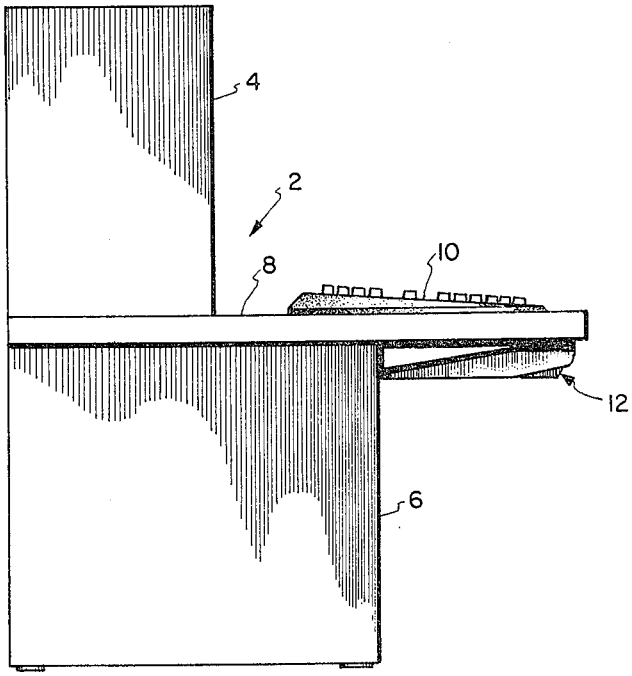
FIG. 2 is a side view of the console shown in FIG. 1 but with the engineers keyboard retracted.

Referring now to the drawings in more detail, there is shown in FIGS. 1 and 2, an operators computer interface console 2. The console includes a display device 4 in the form of a cathode ray tube display. The display device 4 is mounted as an upper assembly on a base member 6. The base member 6 includes a top 8 which comprises a support for the display member 4 and provides a work surface area. An operators keyboard 10 is mounted in the work surface area of the top 8. An engineers keyboard 12 is retractably secured to the top 8 to be selectively positioned at the front edge of the top 8 or retracted to lie completely beneath the top 8. In FIG. 1, the engineers keyboard 12 is illustrated in operative position, in front of the top 8 of the base member 6. In this position the authorized engineer may make the appropriate engineering changes in the internal programming of the computer to effect the changes in format, data base, etc. In FIG. 2, the engineers keyboard 12 is illustrated in its retracted position where it is inaccessible to the operator.

Figure 3:
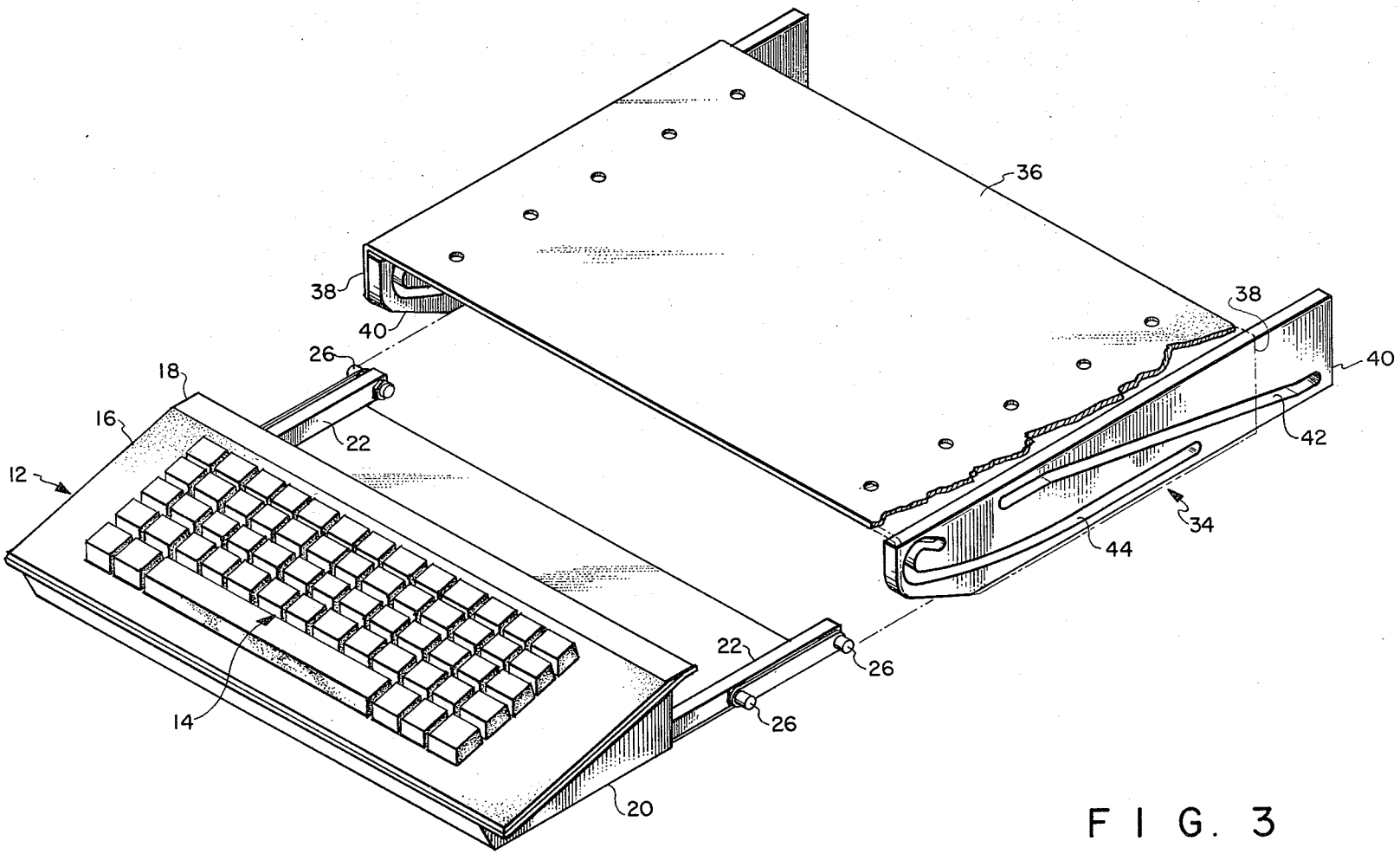
FIG. 3 is an exploded view of an engineers keyboard and mounting bracket in accordance with the present invention.
Figure 4:
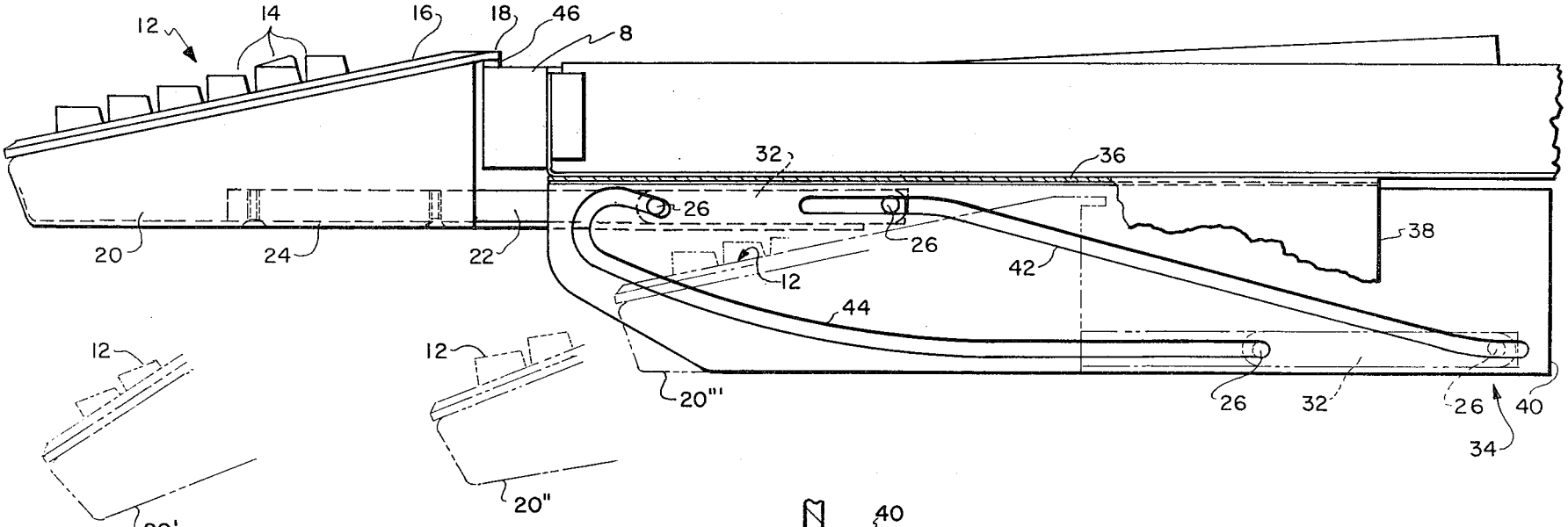
FIG. 4 is a side view of the engineers keyboard and mounting bracket assembly in accordance with the present invention.
Figure 5:
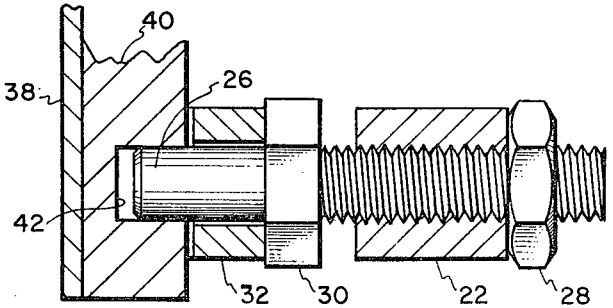
FIG. 5 is a cross-sectional view of a structural detail of the assembly shown in FIG. 4.

In FIGS. 3, 4 and 5, there are shown details of a mounting bracket for retractably supporting the engineers keyboard. The keyboard includes a usual complement of keys 14 mounted in a surrounding bezel 16. The bezel 16 has an extending lip 18 which extends beyond the structure of the keyboard in the direction of the nominal top of the keyboard. The functional apparatus associated with the keys 14 are enclosed in a housing member 20. A pair of cantilever support arms 22 extend from the rear of the housing 20. The bottom plate 24 of the housing 20 extends rearwardly of the housing 20 and spans the space between the two support arms 22, giving lateral support to those arms. A pair of guide pins 26, shown in enlarged cross-section in FIG. 5, extend outwardly from each of the two support arms 22. The two pins 26 in each of the arms 22 are spaced from each other, longitudinally of the arms 22, a distance to give cantilever support for the keyboard assembly. In an operative embodiment constructed in accordance with the present invention, the pins 26 were spaced about $3\frac{1}{2}$ inches on centers. As shown in FIG. 5, the guide pins 26 have a smooth cylindrical outer end with the opposite end threaded. The threaded end is screwed into matching threads in the support arms 22. A jam nut 28, locks the guide pin structure in the desired position within the support arm 22. A fixed head 30 is integrally formed on the pin structure 26 at the interface between the threaded portion and the smooth cylindrical portion. A spacer bar 32 comprises an enlongated bar member having a pair of poles therethrough spaced complementary with the pair of guide pin members on each of the two support arms 22. With the spacer bars 32 in place relative to the two guide pins 26, spacing stability is provided for each pair guide pins.

A mounting bracket 34 is arranged to be secured to the underside of the top member 8 of the base member 6. The bracket 34 includes a main body plate 36. The plate 36 is basically a wide flat plate having the outer side extremities 38 bent downward at a 90° angle to provide unitary side members for the bracket. To the inner surface of each of the side members 38, there is secured a support guide member 40. Whereas the plate 36 with its side members 38 may be made of relatively rigid sheet steel, the support guide members may be made of a relatively thick tough plastic material or the like. In an exemplary embodiment constructed in accordance with the present invention, the support guide members were made of a fiber-filled phenolic resin such as that known in the art as Bakelite and was substantially ⅜" in thickness. The support guide members may be secured to the side member 38 by means of suitable screws not shown. Each of the support guide members 40 is provided with a first and second guide groove 42 and 44, respectively. In each of the support guide members, the grooves 42 and 44 are open toward the inward surface of the guide member and are so arranged that the guide pins 26 fit into and are movable within the respective guide grooves 42 and 44. The rearmost guide groove 42 has a forward end which is parallel to and adjacent the upper edge of the support guide member 40. The rearmost end of the groove 42 is parallel to and adjacent the lower edge of the support guide member 40, the two end portions being substantially horizontal. Intermediate the two end portions of the groove 42 is an inclinded or slopping portion which connects the two end portions. The rearmost guide pin 26 fits into and is adapted to be moved along the path defined by the guide groove 42. The forward groove 44 has a rearward portion about one-third of the length of the groove, parallel to and adjacent the lower edge of the support guide member 40. The groove then curves upwardly toward the front of the support guide member 40 and terminates in a button hook or re-entrant curve providing a terminal detent. The forwardmost guide pin 26 is positioned to fit into and move along the path defined by the forward groove 44.

In the operational position shown in full line in FIG. 4 and illustrated pictorially in FIG. 1, the engineers keyboard 12 is supported by the pins 26 extending into the grooves 42 and 44 in the mounting bracket assembly 34. The rearmost pin 26 rests in the groove 42 at an intermediate position along the upper flat portion of that groove. The forward pin 26 rests in the forward terminal detent of the reentrant curve of the groove 44. Additionally, the lip 18 extending rearwardly from the bezel 16 of the engineer's keyboard overlays and rests upon the forward edge of the work surface of the top 8 of the base member 6. The underside of the lip 18 carries a cushion or pad 46 to cushion the engagement of the lip 18 on the edge of the top member 8. That engagement of the lip 18 with the work surface top 8 gives additional support to the engineer's keyboard during at such time as the keyboard is operational and being manipulated by an engineer. When the authorized engineer has completed his manipulation using the keyboard 12, the keyboard may then be moved to its retracted or stored position. To accomplish that, the engineer grasps the keyboard 12 moving it slightly upward and forwardly to clear the lip from the edge of the work surface 8. During this time the forward pin 26 moves forwardly in the groove 44 around the forward button-hook bend. When the engineers keyboard 12 is moved in a direction to cause the pins 26 to follow the prescribed path within the two grooves 42 and 44 the engineer's keyboard 12 is lowered to the position 20" shown in FIG. 4 then to the position 20" in FIG. 4, thence to the fully stored position shown at 20" shown in FIG. 4. In the stored position the keyboard is fully supported on the cantilever arms 22 secured to the pins 26 resting in the lower flat portion of the grooves 42 and 44. To return the engineer's keyboard to the operational position, the keyboard is pulled forward from the stored position, through the path defined by the grooves 42 and 44, to the position shown in FIG. 1.

Thus there has been provided, in accordance with the present invention, an improved computer interface console with a retractable engineers keyboard wherein the support structure for the keyboard allowing the keyboard to be readily moved between an operational position and a fully retracted, stored position, is simple in structure and operation.

The embodiments of the invention in which an exclusive property or privilege is claimed are defined as follows:

1. A computer interface control console arranged to interface with a digital computer, said console comprising:

a base member having a top member, an operator's keyboard mounted on the surface of said top member of said base member for connection to said computer to effect operational control interface with said computer, an engineer's keyboard for connection to said computer to enable the making of engineering changes in said computer operation, mounting means for movably mounting said engineer's keyboard on said top member for movement between an operational position in front of said top member and a retracted stored position at the underside of said top member, said mounting means including a mounting bracket secured to the underside of said top member, a pair of support guide members secured to said mounting bracket, said engineer's keyboard includes a pair of cantilever support arms extending therefrom, and guide means carried by said support arms in engagement with said guide members on said mounting bracket for movably supporting said engineer's keyboard through said two positions.

2. A computer interface control console as set forth in claim 1 wherein said guide means carried by said support arms comprise a pair of spaced guide pins extending outwardly from each of said arms, and wherein said support guide members on said mounting bracket include a pair of vertically extending plate members each having a pair of guide and support grooves therein, said guide pins on said support arms extending, respectively, into said grooves whereby to support and guide the movement of said engineer's keyboard.

3. A computer interface control console as set forth in claim 2 wherein a first one of each of said pair of grooves defines a sloping path between an upper and a lower horizontal flat, and said second one of each of said pair of grooves a re-entrant curved path between an upper detail position and a lower flat.

4. A computer interface control console as set forth in claim 3 wherein said engineer's keyboard includes means defining a lip extending rearwardly of said engineer's keyboard, said lip engaging and resting on the forward edge of the upper surface of said top member whenever said engineer's keyboard is moved to said operative position whereby to augment the support of said engineer's keyboard in said operative position.

* * * * *